US006032906A

United States Patent [19]

Potter et al.

[11] Patent Number: 6,032,906

[45] Date of Patent: Mar. 7, 2000

[54] POINT DRIVE UNIT

[75] Inventors: William George Potter; Colin Burton, both of Chippenham; Lee Antony Jones, Bradford-on-Avon, all of United Kingdom

[73] Assignee: Westinghouse Brake and Signal Holdings Limited, Chippenham, United Kingdom

[21] Appl. No.: 09/077,158

[22] PCT Filed: Nov. 13, 1996

[86] PCT No.: PCT/GB96/02752

§ 371 Date: May 21, 1998

§ 102(e) Date: May 21, 1998

[87] PCT Pub. No.: WO97/19845

PCT Pub. Date: Jun. 5, 1997

[30] Foreign Application Priority Data

Nov. 30, 1995 [GB] United Kingdom ..... 9524541

[51] Int. Cl.[7] ..... B61L 5/00

[52] U.S. Cl. ..... 246/257

[58] Field of Search ..... 246/257, 258, 246/259, 262, 263

[56] References Cited

U.S. PATENT DOCUMENTS

| | | | |
|---|---|---|---|
| 1,015,138 | 1/1912 | Cordero | 246/428 |
| 1,251,218 | 12/1917 | Gonzales | 246/257 |
| 1,775,811 | 9/1930 | Coleman | 246/257 |
| 3,842,256 | 10/1974 | Crutsch et al. . | |
| 4,428,552 | 1/1984 | Frank et al. . | |
| 4,870,906 | 10/1989 | Schaffer et al. . | |
| 5,687,935 | 11/1997 | Durchschlag et al. | 246/257 |

FOREIGN PATENT DOCUMENTS

| | | |
|---|---|---|
| 0283808 | 8/1991 | European Pat. Off. . |
| 2458442 | 1/1981 | France . |
| 2649060 | 1/1991 | France . |

*Primary Examiner*—Mark T. Le
*Attorney, Agent, or Firm*—Sonnenschein Nath & Rosenthal

[57] ABSTRACT

A point drive unit (10) is disclosed for driving railway points to move via a connecting means of the points located generally centrally between two of the rails (3) of the railway track. The unit comprises a housing (11, 12) adapted to be installed between the two of the rails; a cylinder (18) enclosing a piston (19) which is moveable for driving the points, the cylinder being mounted within the housing at a location laterally offset to one side of the housing; control means mounted within the housing at a location laterally adjacent the cylinder for controlling the supply of fluid to the cylinder to control the movement of the piston; and an offset coupling (20) for coupling the piston to the connecting means so that the piston is laterally offset from the connecting means.

6 Claims, 4 Drawing Sheets

POINT DRIVE UNIT

The present invention relates to point drive units for driving railway points (switches) to move.

Referring to FIG. 1, certain railway points 1 (illustrated only partially) are conventionally driven by a pneumatic cylinder 2 installed generally centrally between two of the rails 3 of the railway track. The cylinder is controlled remotely via pipes 4. An alternative arrangement, which is illustrated in FIG. 2, is to drive the points using a hydraulically self-contained unit, which requires no remote hydraulic supply. The unit shown schematically in FIG. 2 has an electrically driven hydraulic pump 5 which pressurises fluid from a local reservoir 6 to drive a hydraulic cylinder 7. The unit is too large to fit between the rails so the cylinder is coupled to the points via a linkage shown schematically at 8.

To save space and the use of vulnerable supply pipes, it is desirable to have the drive unit installed entirely in the space between the rails of the track. However, the space between the rails is limited, particularly in multi-rail railways, so any unit that is to fit between the rails must be very compact. Also, as shown in FIGS. 1 and 2, the points typically have a connecting rod 9 which lies generally parallel with and generally centrally between two of the rails. The natural approach in designing units to fit between the rails has therefore been to try to mount a cylinder in line with the connecting rod 9 as has previously been the case in systems like that shown in FIG. 1. However, it has now been appreciated that locating the cylinder in this way has prevented the other components of a unit more complex than that shown in FIG. 1 being arranged so that the unit can fit between the rails.

FR-A-2 649 060 discloses a point drive unit in which a cylinder is mounted laterally offset to one side of a central longitudinal axis of a housing including control means. An electro-hydraulic control is mounted at a location laterally adjacent the cylinder but the cylinder is still in line with the connecting rod of the points.

According to the present invention there is provided a point drive unit for driving railway points to move via a connecting means of the points comprising a connecting rod located generally centrally between and lying parallel with two of the rails of the railway track, the unit comprising:

a housing adapted to be installed between said two of the rails, the housing having a central longitudinal axis which is generally centrally located between said two of the rails and generally parallel with them in use of the unit;

a cylinder enclosing a piston which is moveable in a direction parallel to said longitudinal axis of the housing for driving the points, the cylinder being mounted within the housing at a location laterally offset to one side of said longitudinal axis of the housing;

control means mounted within the housing at a location laterally adjacent the cylinder for controlling the supply of fluid to the cylinder to control the movement of the piston; and an offset coupling for coupling the piston to said connecting rod so that the piston is laterally offset from the connecting rod.

With the cylinder laterally offset to one side of the housing the drive unit can be made more compact than before.

Preferably the control means comprises one or more of:

a fluid reservoir;

a pump, suitably driven by an electric motor, for pressurising fluid from the reservoir;

a valve, suitably actuable by electrical signals, for directing fluid to either end of the cylinder;

at least one check valve for locking the piston in place when required. Items of the control means may be provided in a manifold.

The housing is preferably adapted to be installed between the rails by being of a such a size that it can be installed between the rails without interfering with other equipment and/or by being provided with fixing means located to allow it to be fixed securely in place between the rails. As stated above, the housing is adapted to be installed so that its central longitudinal axis (that is the axis half way between its outermost lateral walls) is generally centrally between said two of the rails and generally parallel with them, the central longitudinal axis of the cylinder then being offset laterally from the central longitudinal axis of the housing. Said two of the rails are preferably adjacent rails to each other.

Preferably the offset coupling comprises an arm for linking the connecting means to the piston so that the proximal end of the connecting means (that is the end nearest the drive unit) and the distal end of the piston (that is the end nearest the connecting means) are spaced apart in a direction parallel to the track.

The present invention will now be described by way of example with reference to the accompanying drawings in which.

Figure 1:
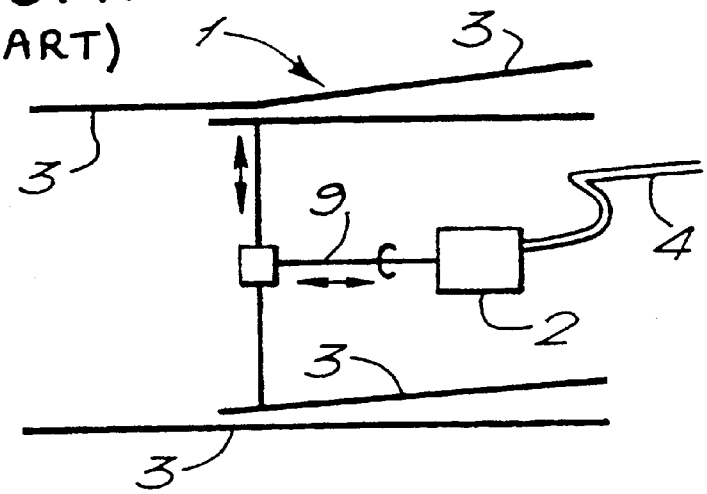
FIG. 1. (PRIOR ART)
FIGS. 1 and 2 show, schematically, conventional point drive units.
Figure 2:
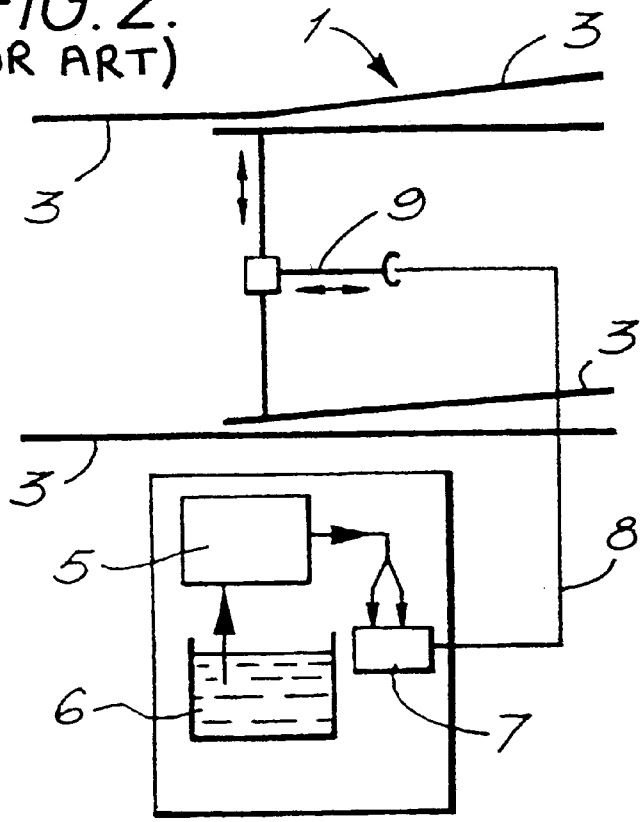
FIG. 2. (PRIOR ART)
Figure 3:
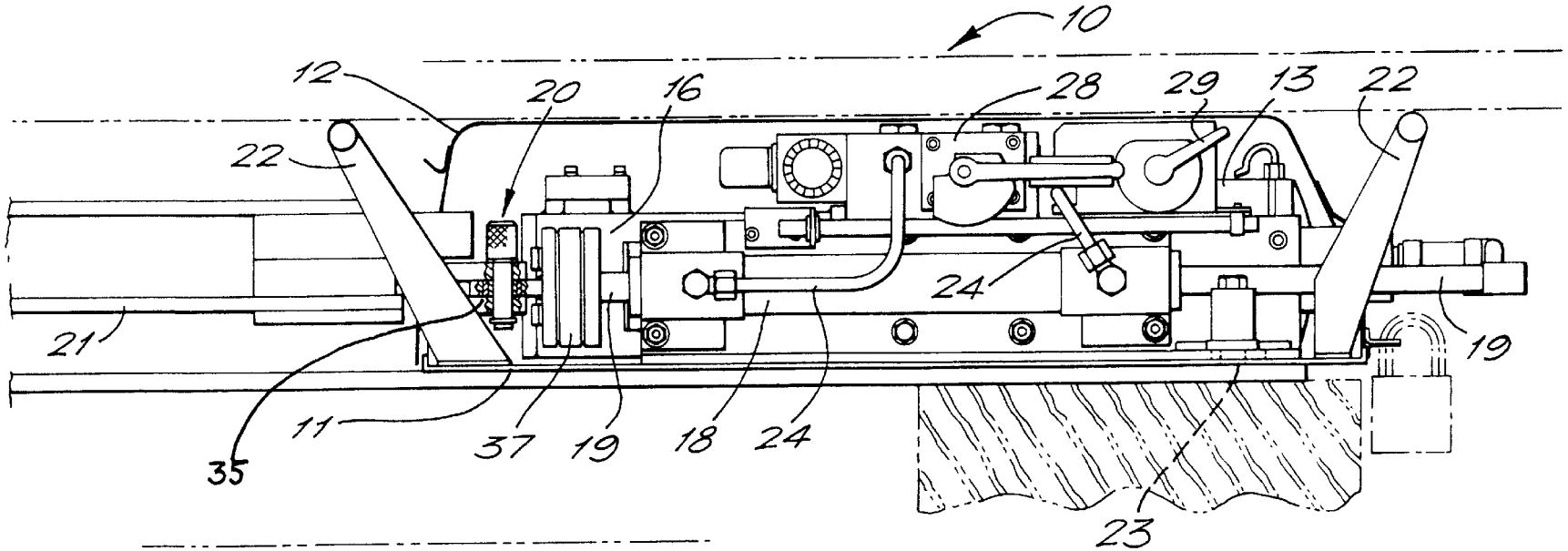
FIG. 3 is a side view of railway point apparatus and a point drive unit according to an example of the present invention, with one side of the outer cover of the drive unit removed for clarity.
Figure 5:
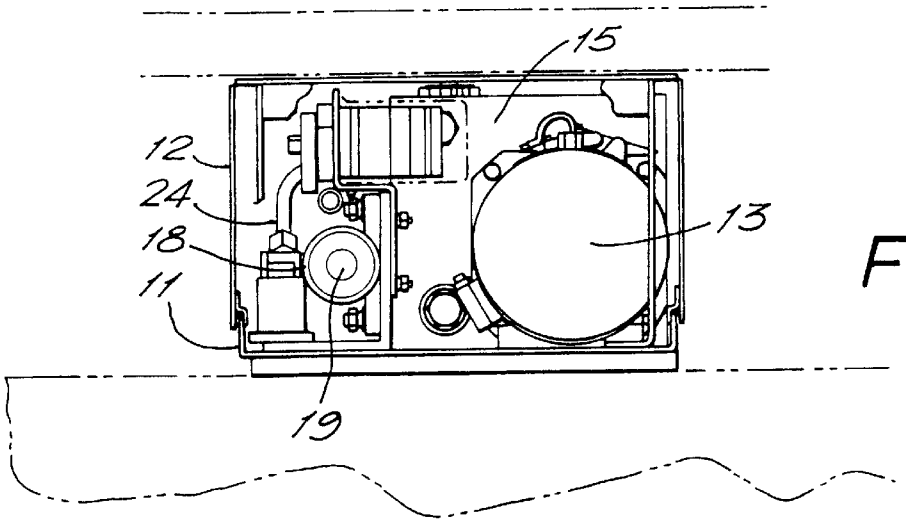
FIG. 5 is an end view on arrow A in FIG. 4 with the end of the outer cover and part of a handle removed for clarity.
Figure 4:
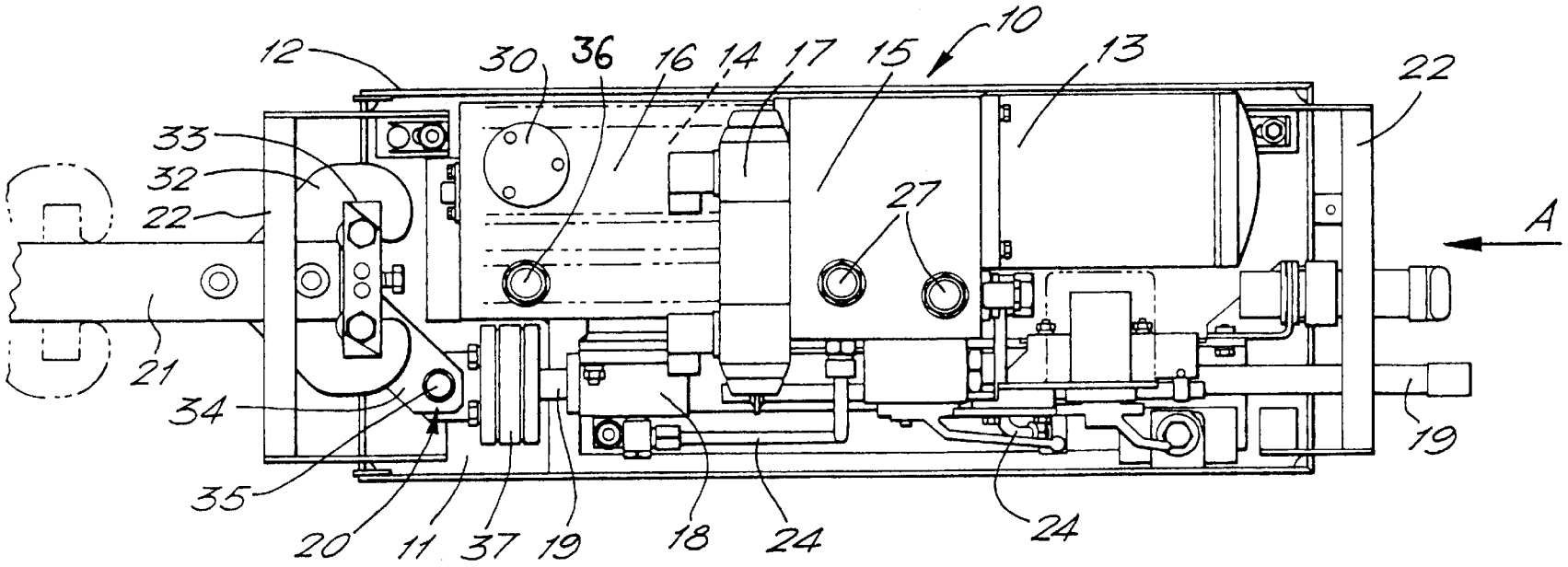
FIG. 4 is a plan view of point apparatus and the point drive unit with the top of the outer cover removed for clarity.

FIGS. 3 to 6 show a point drive unit 10. Within the housing constituted by a base plate 11 and an outer cover 12 is, generally, a motor assembly 13 which drives a pump 14; a manifold block 15 which is supplied by the pump with pressurised hydraulic fluid (e.g. mineral oil) from a reservoir or tank 16; a control valve 17 for controlling the hydraulic output from the manifold; and a double-acting hydraulic cylinder 18 whose piston 19 is coupled via an offset coupling 20 to the connecting rod 21 of the railway points. The cylinder 18 is laterally offset to one side of the housing. This leaves a large region of the housing free for the other components of the point drive unit, which are mounted laterally adjacent the cylinder.

In more detail, the point drive unit comprises a base plate 11 with handles 22 fixed at each end. There are fixing means comprising through holes 23 in the base plate to allow it to be installed with bolts and/or quick release fastenings between the rails 3 of a railway, preferably generally centrally between the rails that are immediately on either side of it. Covering the unit is an outer cover 12 of plastic-coated sheet metal. The cover can be padlocked to the base plate for security. Within the housing the manifold block 15, which is machined from aluminium, acts as the core of the unit, with the other major components mounted to it. The motor 13 is a series-wound d.c. motor rated at 110 V and drawing 7 A at its operating speed. It is coupled via an elastomeric spider coupling to the gear pump 14, which is enclosed by the tank 16. The tank is filled through a cap 36 which incorporates a spring-loaded ball valve. When the cap is closed this valve will allow air to vent out of the tank under slight pressure, but will impede the escape of fluid. Ingress of air is prevented by the valve, and this ensures that no dirt may enter the system. On the end of the tank is a sight-glass giving a direct view of the fluid level. The cylinder is connected to the manifold by pipes 24.

Figure 6:
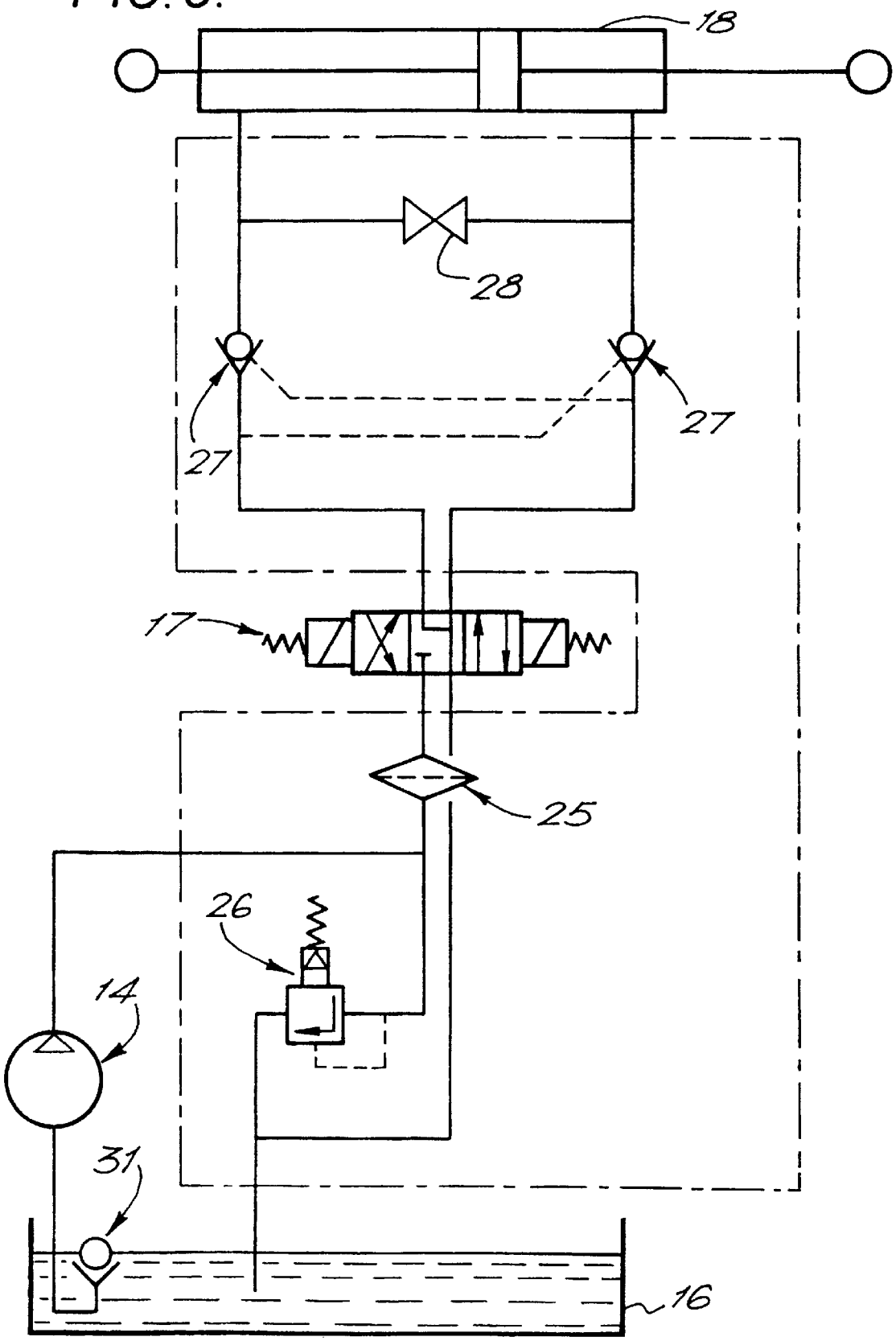
FIG. 6 shows the hydraulic circuit of the point drive unit.

Referring especially to FIG. 6, the operation of the unit is as follows. The pump 14 pressurises fluid from the tank 16 and passes the pressurised fluid through a pressure filter 25. A pilot-operated pressure relief valve 26 venting to the tank is provided in case of over pressure. From the filter 25 the fluid passes to the solenoid-actuated control valve 17. In its default setting this disconnects the pump from the remainder of the circuit but it can be actuated electrically to direct the fluid in either direction to the cylinder 18. When the control valve is not actuated the cylinder 18 is locked by pilot-operated check valves 27. To allow the cylinder to be operated manually (if the unit fails) a manually operated bypass valve 28 is provided to allow the check valves 27 to be bypassed. Within the chain dotted line in FIG. 6 are the components included within the manifold block 15.

A multi-pin bayonet lock connector allows the unit to be connected to electrical power and control signals from a remote control centre. An isolator switch 29 is provided which can break all connections to the unit. As a safety feature the bypass valve 28 is interlocked with the isolator switch so that the unit cannot be activated electrically until the bypass valve is closed. Access to the bypass valve and the isolator switch is gained through a lockable hatch in the outer cover. Another safety feature is that the level of fluid in the tank is monitored by a float switch 30, and this is linked through the unit's electrical connector to a remote alarm unit. Also, an anti-air float valve 31 is provided to seal the inlet to the pump if the level of fluid in the tank falls too far.

As explained above, the cylinder is offset to one side of the drive unit as a whole. Because of this, when the drive unit is installed between the rails the piston is generally offset from the connecting rod of the points. An offset coupling 20 is therefore provided to couple the distal end of the piston to the proximal end of the connecting rod. In the illustrated embodiment (where the drive-unit is connected to the jaw 32 of a "FOUR FOOT" (4 ft) mechanism) the offset coupling comprises a clamp 33 for engaging the jaw of the 4 ft. mechanism, an arm 34 and a spherical bearing 35 between the arm and the piston. The arm 34 is rigidly attached to jaw 32 and spherical bearing 37 is coaxial with the axis of piston rod 19, so that no side-loading is transmitted to the piston rod. To take up small transverse errors of assembly and movement, a coupling member 37 is fitted with non-friction PTFE bearing elements.

The pump may suitably provide a pressure of 100 bar, at which the cylinder may provide a thrust of 4900 N with a stroke of 203 mm achieved in around 2.5 seconds.

We claim:

1. A point drive unit for driving railway points to move via a connecting means of the points comprising a connecting rod located generally centrally between and lying parallel with two rails of a railway track, the unit comprising:

a housing adapted to be installed between said two rails, the housing having a central longitudinal axis which is generally centrally located between said two rails and generally parallel with the two rails when the unit is in use;

a cylinder enclosing a piston assembly which is moveable in a direction parallel to said longitudinal axis of the housing for driving the points, the cylinder being mounted within the housing at a location laterally offset to one side of said longitudinal axis of the housing;

control means mounted within the housing at a location laterally adjacent the cylinder for controlling a supply of fluid to the cylinder to control the movement of the piston assembly; and an offset coupling which couples the piston assembly to said connecting rod so that the piston assembly is laterally offset from the connecting rod.

2. A point drive unit as claimed in claim 1, wherein the control means comprises a fluid reservoir and a pump for pressurising fluid from the reservoir for supply to the cylinder.

3. A point drive unit as claimed in claim 2, wherein the pump is an electrically drive pump.

4. A point drive unit as claimed in claim 1, wherein the control means comprises a control valve for directing fluid to either end of the cylinder.

5. A point drive unit as claimed in claim 4, wherein the control valve is actuable by electrical signals.

6. A point drive unit as claimed in claim 1, wherein the offset coupling comprises an arm for linking the connecting rod to the piston assembly so that the distal end of the piston assembly and a proximal end of the connecting rod are spaced apart longitudinally.

* * * * *